US010518147B2

(12) United States Patent
Kellam

(10) Patent No.: US 10,518,147 B2
(45) **Date of Patent: *Dec. 31, 2019**

(54) GOLF TEE ENCAPSULATING SPARK INDUCTION MATERIAL AND METHOD FOR IMPROVING GOLF PERFORMANCE

(71) Applicant: John A. Kellam, Basking Ridge, NJ (US)

(72) Inventor: John A. Kellam, Basking Ridge, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/003,745

(22) Filed: Jun. 8, 2018

(65) Prior Publication Data

US 2018/0296893 A1 Oct. 18, 2018

Related U.S. Application Data

(63) Continuation-in-part of application No. 15/348,155, filed on Nov. 10, 2016, now Pat. No. 9,993,706, (Continued)

(51) Int. Cl.
*A63B 69/36* (2006.01)
*A63B 57/10* (2015.01)
(Continued)

(52) U.S. Cl.
CPC ..... *A63B 57/10* (2015.10); *A63B 69/3617* (2013.01); *A63B 2071/0625* (2013.01); *A63B 2102/32* (2015.10)

(58) Field of Classification Search
CPC ..... A63B 57/10; A63B 69/3617; A63B 2071/0625; A63B 2102/32; A63B 57/18; A63B 2209/00; A63B 2071/0694
See application file for complete search history.

(56) References Cited

U.S. PATENT DOCUMENTS 1,815,520 A * 7/1931 McLeod ..... A63B 57/10 473/399
2,440,473 A * 4/1948 William ..... A63B 57/10 473/395
(Continued)

FOREIGN PATENT DOCUMENTS

WO WO 2008/013378 1/2008 ..... A63B 57/00
WO WO 2011078469 6/2011 ..... A63B 57/00

OTHER PUBLICATIONS

"Univeristy of Pittsburg Safety Manual: Subject: Combustible Metals", Sep. 10, 2013, retrived on May 8, 2015, http://ehs.pitt.edu/assets/docs/combustible-metals.pdf pp. 1-7.
(Continued)

*Primary Examiner* — Steven B Wong
(74) *Attorney, Agent, or Firm* — Ernest D. Buff & Associates, LLC; Ernest D. Buff; Margaret A. LaCroix

(57) ABSTRACT

A golf tee has a contact alert material encapsulated therein. The golf tee includes a top portion with top, side and bottom walls fixedly attached to a shaft that terminates into a point appointed to be inserted into a ground surface. A cavity is formed between the top, side and bottom walls of the top portion. A contact alert material is encapsulated within the cavity and is composed of a combustible material that generates a spark on impact. The contact alert material is appointed to generate the spark during a golf swing when a golf club strikes the ball and the side walls. The alert is provided immediately as instantaneous feedback during the golf swing adapted to thereby improve muscle memory required to reliably replicate a proper golf swing.

19 Claims, 11 Drawing Sheets

Related U.S. Application Data which is a continuation-in-part of application No. 14/757,188, filed on Dec. 2, 2015, now Pat. No. 9,526,959, which is a continuation-in-part of application No. 13/694,591, filed on Dec. 14, 2012, now abandoned.

(51) Int. Cl.
*A63B 102/32* (2015.01)
*A63B 71/06* (2006.01)

(56) References Cited

U.S. PATENT DOCUMENTS 3,435,554 A 4/1969 Philips ..... 446/22
3,559,998 A * 2/1971 Kelly ..... A63B 57/13 473/396
3,947,027 A 3/1976 Brown ..... 473/278
3,954,263 A * 5/1976 Whelan ..... A63B 57/10 473/399
3,992,011 A 11/1976 Jessee ..... 473/268
4,131,280 A 12/1978 Poortman ..... 473/199
4,787,637 A * 11/1988 Lima ..... A63B 57/10 473/396
4,893,818 A * 1/1990 Liccardello ..... A63B 57/207 473/396
4,898,389 A 2/1990 Plutt ..... 473/223
4,905,999 A * 3/1990 Voinovich ..... A63B 57/10 473/386
5,085,431 A * 2/1992 McGuire ..... A63B 57/10 473/386
5,085,438 A * 2/1992 Takeno ..... A63B 57/10 473/399
5,120,358 A 5/1992 Pippett ..... 106/31.01
5,154,417 A * 10/1992 Kohli ..... A63B 57/10 473/401
5,356,146 A * 10/1994 Blosser ..... A63B 57/15 473/400
5,431,392 A * 7/1995 Carson ..... A63B 57/10 473/399
5,597,361 A 1/1997 Hope ..... 473/237
5,830,077 A * 11/1998 Yavitz ..... A63B 69/3617 473/226
5,890,976 A * 4/1999 Anderson ..... A63B 57/15 473/398
6,290,616 B1 * 9/2001 Evans ..... A63B 57/10 473/399
6,309,315 B1 * 10/2001 Adams ..... A63B 69/3617 473/387
6,319,156 B1 11/2001 Alexsen ..... 473/339
6,344,004 B2 * 2/2002 Adams ..... A63B 69/3617 473/387
6,487,971 B1 * 12/2002 Anderson ..... F42B 3/113 102/201
6,506,131 B2 * 1/2003 Adams ..... A63B 69/3617 473/387
6,679,792 B1 * 1/2004 Dorfman ..... A63B 57/10 473/387
6,692,382 B2 * 2/2004 Adams ..... A63B 69/3617 473/387
6,832,964 B2 * 12/2004 Adams ..... A63B 69/3617 473/387
6,997,822 B2 * 2/2006 Adams ..... A63B 69/3617 473/387
7,169,067 B2 1/2007 Town ..... 473/417
7,238,124 B2 * 7/2007 Adams ..... A63B 69/3617 473/387
7,481,725 B2 * 1/2009 Adams ..... A63B 69/3617 473/387
7,604,554 B2 10/2009 Otsubo ..... 473/387
7,959,525 B1 6/2011 Brown ..... 473/387
8,083,615 B2 12/2011 Wood et al. ..... 473/387
9,526,959 B2 * 12/2016 Kellam ..... A63B 57/10
9,993,706 B2 * 6/2018 Kellam ..... A63B 57/10
2004/0162153 A1 8/2004 Adams et al. ..... 473/237
2005/0085319 A1 * 4/2005 Eckert ..... A63B 57/10 473/399
2005/0101413 A1 5/2005 Adams et al. ..... 473/387
2005/0127630 A1 6/2005 Kuhlman ..... 280/87.042
2006/0264272 A1 * 11/2006 Calderon, Jr. ..... A63B 57/13 473/387
2009/0143159 A1 6/2009 Murph et al. ..... 473/239
2011/0256963 A1 10/2011 Goodwin ..... 437/387
2012/0065000 A1 3/2012 De Lisle ..... 473/387
2013/0165273 A1 6/2013 DeLisle ..... 473/399

OTHER PUBLICATIONS

Chang, Jon, "Titanium Golf Clubs Can Toss 3,00-Dergree Sparks", http://abcnews.go.com/Technology/titanium-golf-clubs-toss-3000-degree-sparks/story?id=22973386 retrieved on Jun. 25, 2014.

* cited by examiner

GOLF TEE ENCAPSULATING SPARK INDUCTION MATERIAL AND METHOD FOR IMPROVING GOLF PERFORMANCE

This is a Continuation-In-Part of U.S. application Ser. No. 15/348,155 filed Nov. 10, 2016 which, in turn, is a Continuation-In-Part of U.S. application Ser. No. 14/757,188 filed Dec. 2, 2015 which, in turn, is a Continuation-In-Part of U.S. application Ser. No. 13/694,591 filed Dec. 14, 2012 for "Golf Tee with Spark Induction Coating and Method for Improving Golf Performance", the disclosures of which are hereby incorporated in their entirety by reference thereto.

BACKGROUND OF THE INVENTION

1. Field of the Invention

The present invention relates to golfing devices and methods; and more particularly, to golfing devices and methods that are designed to perfect a golfer's swing, increase ball contact and improve golf performance.

2. Description of the Prior Art

The sport of golfing has become a major entertainment and business industry. Frequently business meetings and dealings take place on the golf course. Social events and outings often are carried out on golf courses. Consequently, individuals of all golfing levels frequently search for methods and devices to improve their golf game. Notwithstanding the plethora of such methods and devices, the improvement of golf prowess can be challenging. Golfers have long known that a proper golf swing is an important component of good golfing technique. Extra care must be taken by the golfer to ensure optimal stroke carry through. A necessary prerequisite for proper golf form is the requirement that a golfer keep his head down during the swing. This condition is actually quite challenging in that golfers frequently forget to keep their head facing downward during the swing and, in doing so, overlook an important swing requirement. Without proper form a tee shot is much less likely to find the fairway.

Golf outings represent a form recreational sporting activity; but additionally, provide opportunities to improve business relations, develop inter-company networking and conduct business transactions. For many golfers, the desire to increase performance cannot be understated. While various training devices and methods have been disclosed and utilized, many of these devices and methods are complicated and costly.

Numerous methods and devices have been proposed that attempt to improve a golfer's performance. Such devices and methods are summarized herein below.

U.S. Pat. No. 3,435,554 to Philips discloses a sparking hammer generally having a lower head portion provided with an external bellows, to which is secured a plate. A striker bar, serrated on its exterior, frictionally engages flint secured to the oscillating extension of a spring in order that it will engage the serrations of the striker bar, when the bellows of the lower head portion strikes a surface.

U.S. Pat. No. 3,947,027 to Brown discloses a high-performance golf tee having a stem, a cup-shaped ball receptacle on the top of the stem, and a projection extending outwardly from the ball receptacle. The extension distance is such that when a golf ball is placed on the tee and a golf club is swung at the ball, the golf club contacts the projection and imparts motion to the ball before the golf club makes direct contact with the surface of the golf ball. The contact between the golf club and the projection imparts an initial backspin on the ball.

U.S. Pat. No. 3,992,011 to Jessee discloses a heads down golf practice device having a resilient tubular golf tee member mounted in and protruding upwardly from a resilient, flat tee support structure base. The base includes a light emitting assembly having a light visible through the interior portion of the resilient tubular golf tee and mechanical indexing elements for randomly selecting a color of the visible light. It does not teach or discloses a golf tee having a contact alert coating.

U.S. Pat. No. 4,131,280 to Poortman discloses an electronic tee off device having a plurality of light-emitting diodes of different colors. These diodes are situated at a location where, when energized, they are visible to a golfer when the golfer is properly positioned with respect to a golf ball appointed to be driven from a tee.

U.S. Pat. No. 4,898,389 to Plutt discloses a self-contained gold training device designed to be integral with or attached to and detached from the head of any golf club. The device gives a golfer an exact indication of the point of impact of the face of a golf club with a golf ball.

U.S. Pat. No. 5,085,431 to McGuire discloses a golf tee providing a pliant riser and a rigid anchor. A placement tool providing means for placement of said golf tee into the ground. The anchor having enough length and exposed surface area to provide the required friction needed to hold said golf tee firmly in place even after being struck by a golf club used to hit a golf ball teed up on said golf tee. The placement tool consisting of a tool handle, a tool shaft and a tool sleeve is used to place said golf tee into the ground such that the anchor head is below the ground surface a distance calibrated by the tee height indicator on the riser. There is no disclosure of a coating on the placement tool, which is utilized for placing a golf tee into the ground. Furthermore, the placement tool and golf tee do not emit a spark that immediately indicates proper golf stroke form.

U.S. Pat. No. 5,120,358 to Pippett discloses that determination of the point of impact on a golf club face with a golf ball is facilitated through the use of a flowable chalk compound placed on the ball at the intended point of contact with the club face. The flowable chalk compound includes a homogeneous, paste-like mixture of a major proportion of a solid, finely divided pigment and a minor proportion of a grease-like material. Upon impact, the chalk compound will make a visible mark on the club head face that may be observed by the golfer. There is no disclosure of a coating on the golf tee. Instead the chalk compound is placed on the ball. Furthermore, the chalk compound does not provide immediate feedback concerning of the golf club stroke, since the club head face must be observed after the golf swing in order to discern the point of contact between the club head and the ball.

U.S. Pat. No. 5,356,146 to Blosser discloses a golf tee having successive contrasting color stripes around most of its length. A golfer can determine at a glance how many of the stripes are exposed above the ground in which the tee is set, and thereby determine the height of a golf ball on the tee above the ground. The stripes are arranged in repeated sequences with two or more different colors in each sequence.

U.S. Pat. No. 5,597,361 to Hope discloses a self-adhesive indicator which adheres to a golf club face to provide an indication of the point of impact of the golf ball on the club face. The indicator consists of a sandwich of various layers—a layer of pressure-sensitive adhesive on the bottom, followed by a layer of energy-absorbing elastomeric material on which is provided a film of a thermochromic material such as a temperature sensitive liquid crystal, followed by a top layer of clear high impact plastic.

U.S. Pat. No. 5,830,077 to Yavitz discloses a device for assisting a golfer in improving his or her golf swing. The device includes an impact detector mounted to the club head of a golf club. The impact detector provides an instantaneous visual or audible indication of when a predetermined area, e.g., the "sweet spot", of the club head face strikes the golf ball. There is no disclosure of a coating on the golf tee. Instead the impact detector is mounted to the club head. Modifying the golf club head by mounting the impact detector thereon would disqualify the golf club and lead to stroke penalties if the club were used in recreational and tournament play. Standard regulated golf clubs and golf balls must be unadulterated or un-manipulated as required under golf organization rules and regulations of the United States Golf Association (USGA).

U.S. Pat. No. 5,890,976 to Anderson discloses an encasement device for a golf tee cylindrically adhered to a shaft of golf tee. The encasement device is a cover with graduated markings, which allow the golfer to consistently set the tee at the golfer's desired depth. Each graduated marking is numerically related to other graduated markings and the ground penetration depth. The resulting multi-layer structure of the golf tee and the encasement device deters breakage of the golf tee and reinforces the shaft structure of the golf tee.

U.S. Pat. No. 6,309,315 to Adams discloses a golf tee coated with colored coatings that when struck with a golf club leave a marking that easily identifies where the ball was struck on the club face and the path of the swing but does not come off in normal handling. The tee leaves a multi-colored marking on the club face that is used to show the swing path of a golfer's swing and the point of impact of the tee on the face of the golf club. The tee has a center line or mark that represents the middle, which establishes the optimum hitting area. This line or mark is also an indicator for the golfer to line up in the direction they are trying to hit the ball. On either side of this colored line or mark is a different color that indicates the swing path when shown on the club face.

U.S. Pat. No. 6,319,156 to Alexsen discloses a biodegradable golf tee having fertilizer properties, as well as a method of making the golf tee.

U.S. Pat. No. 6,832,964, U.S. Patent Application Publication Nos. 20040162153 and 20050101413 to Adams et al. disclose a golf tee coated with colored coatings which, when struck with a golf club, leave a marking that easily identifies where the ball was struck on the club face and the path of the swing, but does not come off in normal handling. The tee leaves a multi-colored marking on the club face that is used to show the swing path of a golfer's swing and the point of impact of the tee on the face of the golf club. There is no disclosure of a spark coating on the golf tee. Instead a colored coating compound leaves a mark on the golf club face. Furthermore, the colored coating does not provide immediate feedback regarding the golf club stroke, since the club head face must be observed after the golf club swing in order to discern the point of contact.

U.S. Pat. No. 7,169,067 to Town discloses a swing training device. A microprocessor controlled set of colored LEDs teach the user to watch the ball during contact by a ball hitting device such as a baseball bat or golf club.

U.S. Pat. No. 7,604,554 to Otsubo discloses a golf tee implementing an anchoring device, an impact energy deflection device and a friction reduction device in one-piece configuration. The tee anchoring device comprises two anchoring fins for initial impact resistance and the recoil dislodgement prevention fin after-impact resistance.

U.S. Pat. No. 7,959,525 to Brown discloses a dual composition polymeric device to be used as a golf tee. The device has a polymeric hollow stiff stem portion with an integral cone portion at its top end; a cone-shaped polymeric flexible face portion mechanically joined to the cone and stiff stem portion; an internal air passage through the center of the cone-shaped flexible face; and a removable mechanical screw joining the cone-shaped flexible face portion with the stiff stem portion and its integral cone portion.

U.S. Pat. No. 8,083,615 to Wood et al. discloses a set of golf tees. The set includes at least a low spin golf tee and a high spin golf tee. The low spin golf tee is constructed to provide decreased resistance to the deformation of a golf ball that is impacted by a golf club while resting on the low spin golf tee.

U.S. Patent Application Publication No. 20050127630 to Kuhlman et al. discloses a spark-emitting device for a skateboard. The spark-emitting device includes a housing and a plurality of misch metal barrels inserted into a housing and spaced apart so that the wear rate of the housing in the misch metal barrels is compatible and a desired sparking effect is achieved. The spark-emitting device for a skateboard is not utilized for golf purposes; no disclosure is contained therein regarding a spark-emitting tee for golf play.

U.S. Patent Application Publication No. 20090143159 to Murph et al. discloses a golf club that provides a universal training tool for golfers of all sizes. The golf club includes an adjustable length shaft having a club head secured at one end thereof and a handle secured at the other end thereof. A sensor circuit disposed in the club head includes a first sensor adapted to generate and transmit a first measurement signal representing a first desired characteristic of the golf club, and a display circuit disposed in the handle.

U.S. Patent Application Publication No. 2011/0256963 to Goodwin discloses a golf tee design that incorporates the functionality of a golf tee while encompassing a novelty explosion at the end of the golfer's swing. The tees are designed to explode upon impact with a golf club. This novelty item is used for entertainment purposes while on the golf course.

U.S. Patent Application Publication No. 2012/0065000 to De Lisle discloses a golf tee including: an elongate shaft having opposed upper and lower ends, the lower end configured to be inserted into an underlying surface; and a support cup that is configured to support a golf ball from beneath and that merges with the shaft. The support cup has a base portion and further includes at least three arcuate support prongs projecting upwardly from the base portion. The support prongs define a discontinuous annulus about the periphery of the support cup.

U.S. Patent Application Publication No. 2013/0165273 to De Lisle discloses a golf tee including an elongate shaft having opposed upper and lower ends, the lower end configured to be inserted into an underlying surface; and a support cup that is configured to support a golf ball from beneath and that merges with the shaft. The support cup has a base portion and further includes at least three arcuate support prongs projecting upwardly from the base portion. The support prongs define a discontinuous annulus about the periphery of the support cup. There is no disclosure of a spark induction coating on the golf tee. Inasmuch as no spark is generated, the golf tee does not provide immediate feedback regarding the golf club stroke.

Foreign Patent Publication No. WO/2011/078469 to Ru discloses a golf tee that prevents the golfer from raising his head up. The golf tee construction comprising inter alia a light emitting lamp built in a laid portion.

Foreign Patent Publication No. WO/2008/013378 to Kim discloses a golf tee for preventing breakage and loss, whose lower portion is partially stuck in the ground and whose upper portion is provided for placing a golf ball thereon, wherein a portion of the golf tee is separated and bent when a golfer hits the golf ball with a driver, thereby absorbing an impact and preventing a breakage and a loss.

Non-patent literature "University of Pittsburgh Safety Manual: Subject: Combustible Metals", Sep. 10, 2013, retrieved on May 8, 2015, http://ehs.pitt.edu/assets/docs/combustible-metals.pdf Pages 1-7 discloses guidelines for the safe use of combustible metals.

Non-patent literature by Chang, Jon, "Titanium Golf Clubs Can Toss 3,000-Degree Sparks", http://abcnews.go.com/Technology/titanium-golf-clubs-toss-3000-degree-sparks/story?id=22973386 retrieved on Jun. 25, 2014 discloses dangers of titanium spark induced golf clubs.

None of the heretofore disclosed and/or utilized devices or methods provides a golf tee for a training aid including a golf ball and a golf club that is economical to produce, easy to use and reliably assists a golfer to achieve proper golfing form. Specifically, none of the heretofore disclosed and/or utilized devices or methods provides a golf tee that is inexpensive to construct, reliable in operation, and provides a readily accessible and entertaining way to improve one's golf swing and provide immediate evidence of the optimal stance and follow through required for proper swing form.

There exists a need in the art for a device or method that provides a low cost, reliable golf tee for use with a golf ball and a golf club that is easy to use and assists a golfer to achieving proper golfing form. In addition, there exists a need in the art for a golf tee that is inexpensive to construct, accurate and reliable in operation, and provides a readily accessible and entertaining way to improve one's golf swing and provide immediate evidence of the optimal stance and follow through required for proper swing form. Further, there is a need in the art to provide a golf tee achieving these features that can be used in compliance with rules and regulations of golf courses and tournaments, for use with standard regulation golf clubs and golf balls.

SUMMARY OF THE INVENTION

The present invention provides a golf tee for use with a golf ball and a golf club, the golf tee encapsulating a contact alert material that generates a spark when struck with a golf club, thereby providing an alert that immediately informs the user whether the user's golf swing has been properly executed. The golf tee, when used with the golf ball and golf club provide a novel training aid that is economical, compact, and encourages proper golfing form. The subject golf tee's spark allows the golfer to really know that he/she kept his/her head down in real time, as the golfer is hitting the ball. This ensures real time direct and immediate feedback that the proper golf stroke was executed, which can immediately be realized by the golfer and/others nearby. Information regarding proper golfing form is provided immediately, during the golf swing, when the golf club head strikes the ball, thereby improving muscle memory required to reliably replicate a proper golf swing. As such, proper golfing form is promoted. The golfer looks for the spark and is thereby encouraged to keep his head in the downward facing position throughout the golf swing.

The subject golf tee comprises a golf tee body having a top portion with a top wall and side walls, the top plate being fixedly attached to a shaft. The shaft terminates into a point appointed for insertion into a ground surface. A ball is placed on the top plate. A contact alert material is encapsulated within a cavity located within at least a portion of the golf tee body or top portion. The contact alert material is composed of a material adapted to generate an alert when a golf club head strikes the ball and the contact alert coating of the golf tee at the coating golf tee interface. More specifically, the contact alert material is a spark inducing composition or a spark and sound generating composition. When used with a golf ball and golf club that do not have a contact alert material thereon, the alert material located within the golf tee generates an alert when struck by the golf club head, thereby immediately informing the user whether the user's golf swing has been properly executed.

The spark induction material or contact alert material is encapsulated within the golf tee as opposed to a coating on the tee. The material is preferably composed of zirconium or mercury fulminate or silver fulminate or similar material that sparks on impact. The tee may be the same shape as an average golf tee or a golf tee that is wider than average. The golf tee may be made of wood or plastic or even a material that pulverizes upon impact with the golf club.

The subject golf tee is especially well suited for use with a golf ball and a golf club to provide an economical and compact training aid that encourages proper golfing form. A golf tee having a contact alert material for use with a golf ball and a golf club having a club head is provided.

In a first embodiment, the golf tee comprises a top portion with a top wall, side walls and a bottom wall, the bottom wall of the top portion being fixedly attached to a shaft that terminates into a point. The point and a portion of the shaft is appointed to be inserted into a ground surface when a golfer is getting ready to tee off and a golf ball is placed on the top wall of the top portion. A cavity formed between the top, side and bottom walls of the top portion and a contact alert material is encapsulated within the cavity. The contact alert material being composed of a combustible material that generates a spark on impact. The contact alert material is appointed to generate the spark during a golf swing when the head of the golf club strikes the ball and the side walls, bending the side walls to strike the contact alert material or fracturing the side walls and striking the contact alert material at a material/golf tee interface. The alert provides immediate as instantaneous feedback during the golf swing adapted to thereby improve muscle memory required to reliably replicate a proper golf swing.

A method of use of a golf tee with a golf training aid having a golf club and a golf ball for encouraging proper golfing form is provided. The golf tee comprising: a) a top portion with a top wall, side walls and a bottom wall, the bottom wall of the top portion being fixedly attached to a shaft that terminates into a point, the point and a portion of the shaft being appointed to be inserted into a ground surface when a golfer is getting ready to tee off and a golf ball is placed on the top wall of the top portion; b) a cavity formed between the top, side and bottom walls of the top portion; and c) a contact alert material being encapsulated within the cavity being composed of a combustible material that generates a spark on impact. The contact alert material is appointed to generate the spark during a golf swing when the head of the golf club strikes the ball and the side walls. The alert is provided immediately as instantaneous feedback during the golf swing adapted to thereby improve muscle memory required to reliably replicate a proper golf swing.

A method of manufacturing a golf tee having a contact alert material for use with a golf ball and a golf club having a club head is also provided including the steps of: a) forming mating first half and second half of the golf tee, each first half and second half having a half of a top wall, side walls with a cavity and a bottom wall, the bottom wall of the top portion being fixedly attached to a half shaft that terminates into a half point; b) inserting a contact alert material composed of a combustible material that generates a spark on impact within each of the cavity of the first half and second half; and c) attaching the first half to the second half to form golf tee so that the contact alert material is encapsulated within the golf tee. The contact alert material is appointed to generate the spark during a golf swing when the head of the golf club strikes the ball and the side walls. The alert is provided immediately as instantaneous feedback during the golf swing adapted to thereby improve muscle memory required to reliably replicate a proper golf swing.

When struck by the head of a golf club, the contact alert material located within the subject golf tee contemporaneously generates an alert in the form of a spark, thereby immediately informing the user as to whether the user's golf swing has been properly executed. Proper golfing form is promoted by encouraging the golfer to see the spark and by so doing keep his head in the downward facing position throughout the golf swing. A golfer simply tees-up the ball in the usual way.

Advantageously, the subject golf tee does not require any alterations to the designs of either the golf ball or the golf club, which would adversely affect the trajectory of the ball. Additionally, information regarding proper golfing form is provided immediately, during the golf swing, when the golf club head strikes the ball, thereby improving muscle memory required to reliably replicate a proper golf swing. The golf tee can be used in compliance with rules and regulations of golf courses and tournaments as it is for use with standard regulated golf clubs and golf balls that are unadulterated or un-manipulated as required under golf organization rules and regulations of the United States Golf Association (USGA).

BRIEF DESCRIPTION OF THE DRAWINGS

The invention will be more fully understood and further advantages will become apparent when reference is had to the following detailed description of the preferred embodiments of the invention and the accompanying drawing, in which.

DETAILED DESCRIPTION OF THE INVENTION

Figure 1:
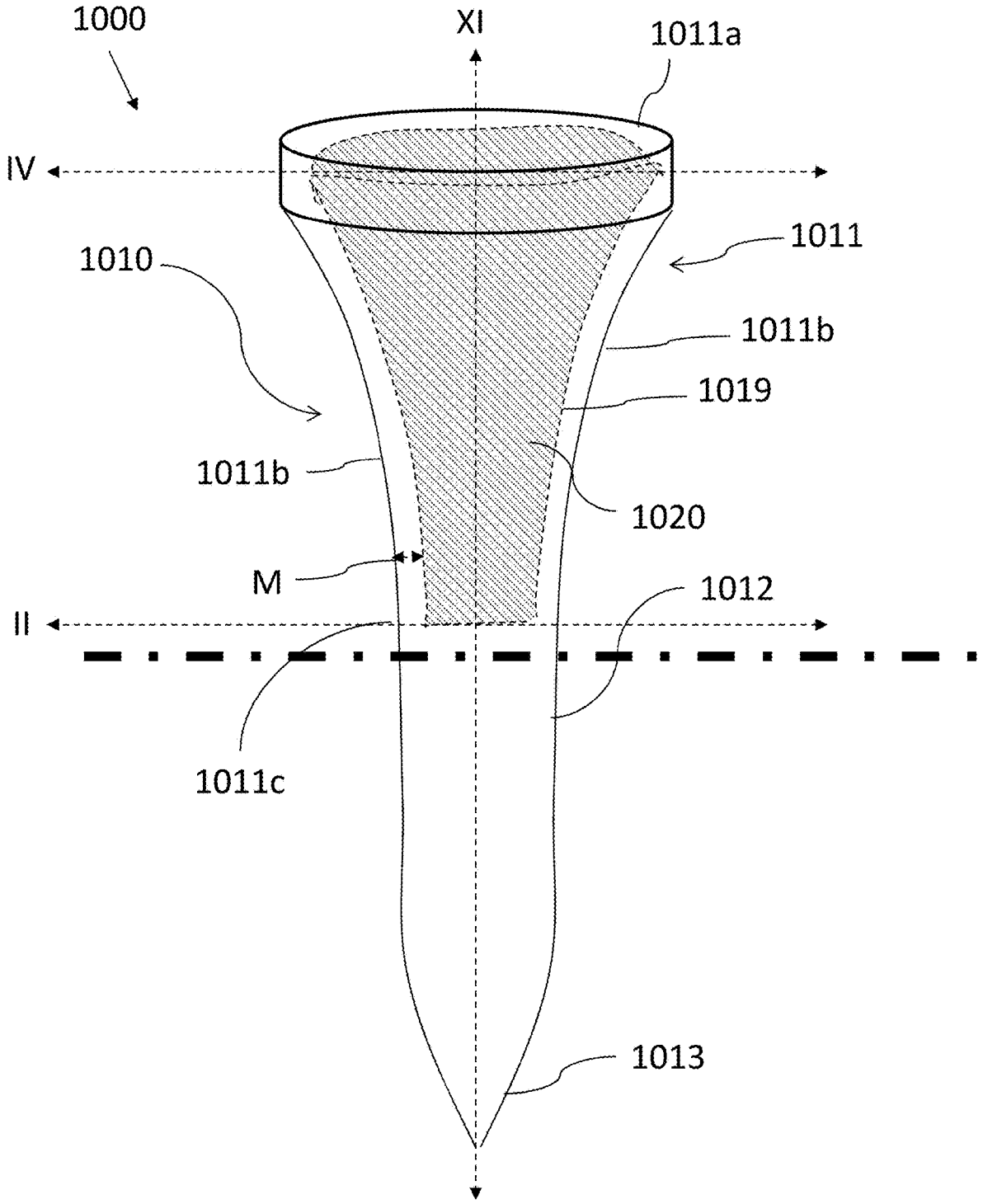
FIG. 1 illustrates a side plan view of an embodiment of the subject golf tee.

This invention relates to a golf tee having a spark generating material is encapsulated therein, and a method of using a golf tee, that sparks only, or in an alternative embodiment sparks and makes an audible sound upon being struck by a golf club. The subject invention is directed towards a golf tee especially suited for use with a golf ball and a golf club.

The subject golf tee comprises a spark induction golf tee with the spark induction material encapsulated within the golf tee, as opposed to a coating or only a coating on the tee. Preferably, the spark induction material is comprised of zirconium or mercury fulminate or silver fulminate or similar material that sparks on impact. The subject golf tee is preferably the same shape as an average golf tee, or it may be wider than the average golf tee. The subject tee may be made of wood or plastic or a material that pulverizes upon impact with the golf club.

The spark induction material or contact alert material is encapsulated within the golf tee as opposed to a coating on the tee. The material is preferably composed of zirconium or mercury fulminate or silver fulminate, nitrocellulose, potassium nitrate and/or priming powder, combinations thereof, or similar material that sparks on impact. The tee may be the same shape as an average golf tee or a golf tee that is wider than average. The golf tee may be made of wood or plastic or even a material but in any event the side walls are very thin or have a shallow thickness so that the side walls break, shatter or pulverize upon impact by the golf club and the golf club instantaneously strikes the spark induction material encapsulated in the golf tee. The golf tee has a contact alert coating substantially, or entirely, encapsulated within the golf tee. In a first embodiment, the golf tee comprises a top portion with a top wall, side walls and a bottom wall, the bottom wall of the top portion being fixedly attached to a shaft that terminates into a point. The point and a portion of the shaft is appointed to be inserted into a ground surface when a golfer is getting ready to tee off and a golf ball is placed on the top wall of the top portion. A cavity is formed between the top, side and bottom walls of the top portion and a contact alert material is encapsulated within the cavity. The contact alert material being composed of a combustible material that generates a spark on impact. The contact alert material is appointed to generate the spark during a golf swing when the head of the golf club strikes the ball and the side walls, fracturing the side walls and striking the contact alert material at a material/golf tee interface. The alert provides immediate as instantaneous feedback during the golf swing adapted to thereby improve muscle memory required to reliably replicate a proper golf swing. The resultant spark allows the golfer to really know that he/she kept his/her head down in real time, as the golfer is hitting the ball. This ensures real time direct and immediate feedback that the proper golf stroke was executed, which can immediately be realized by the golfer and/other nearby. The immediate feedback provided by generation of an alert when the club head contacts the golf ball/golf tee interface constitutes a prerequisite for connoting proper correlation of the arms, torso and legs during the golf swing, to establish the muscle memory required to reliably replicate a proper golf swing and thereby achieve proper golfing form. Even further, the propensity of the golf tee to generate a spark when properly struck, encourages the golfer to look for the spark and keep his head in the downward facing position throughout the golf swing, thereby promoting proper golfing form.

When struck by the head of a golf club, the contact alert material located on the subject golf tee generates an alert in the form of a spark (or a spark with an audible sound, such as a snap or bang), thereby immediately informing the user as to whether the user's golf swing has been properly executed. Proper golfing form is promoted by encouraging the golfer to keep his head in the downward facing position throughout the golf swing. A golfer simply tees-up the ball in the usual way.

Advantageously, the subject golf tee does not require any alterations to the designs of either the golf ball or the golf club, which would adversely affect the trajectory of the ball. Additionally, information regarding proper golfing form is provided immediately, during the golf swing, when the golf club head strikes the ball, thereby improving muscle memory required to reliably replicate a proper golf swing. The golf tee can be used in compliance with rules and regulations of golf courses and tournaments as it is for use with standard regulation golf clubs and golf balls that are unadulterated or un-manipulated as required under golf organization rules and regulations of the USGA.

The golf tee body with its attached shaft is appointed to be inserted into the ground. The contact alert material is encapsulated within at least a portion of the top portion of the golf tee body. The material is composed of a combustible material (preferably a spark inducing composition or a spark and sound generating composition) that will generate an alert when struck by a golf club. Therefore, when a user's golf club head strikes the ball and strikes and breaks or shatters or pulverizes the side wall so the tee, the golf club instantaneously strikes the contact alert material of the Golf Tee at the material/Golf Tee interface, an alert spark is generated thereby immediately informing the user if a golf swing has been properly executed.

Significantly, the alert produced by the contact alert encapsulated material of the subject golf tee is generated, reliably relayed to, and received by the user at the point of impact between the club head and the ball (during the golf swing); not after the golf swing has occurred. Instantaneous feedback is provided, thereby improving muscle memory required to reliably replicate a proper golf swing. No alterations are required to the designs of either the golf ball or the golf club, which would adversely affect the trajectory of the ball. Any alterations of the golf ball and/or golf club could also render the ball and club as falling outside of golf rules and regulations and would likely cause a player to be disqualified in tournaments and league matches.

Advantageously, the subject golf tee device does not require any alterations to the design of the golf ball or golf club, which would adversely affect the trajectory of the ball. Further, it is considerably less expensive and more efficient to place an alert coating on a golf tee, rather than on each and every golf ball being used. Still further, the immediate feedback provided by generation of an alert when the club head contacts the golf ball/golf tee interface constitutes a necessary prerequisite for connoting proper correlation of the arms, torso and legs during the golf swing, to establish the muscle memory required to reliably replicate a proper golf swing and thereby achieve proper golfing form. By having the coating solely on the tee of the subject golf tee, but not on the ball or on the club head face, immediate feedback during the swing (not afterwards) is provided that helps the player lock in the proper swing mechanics, keep his head down, and improve his/her golf swing. These advantages are achieved without causing the user/golfer to be disqualified during a round or golf tournament or game.

Uniquely, the subject golf tee is especially well suited for use with a golf ball and golf club to provide a training aid that is fun to use and entertaining, as well. Proper golfing form is promoted by encouraging the golfer to keep his head in the downward facing position throughout the golf swing. When using the subject golf tee with spark induction material encapsulated therein, a golfer simply tees-up the ball in the usual way. The tee is encapsulated with a substance such as ground-up asphalt, small metallic pieces (for example magnesium; zirconium), gunpowder, black powder, flint, aluminum, aluminum fines, flitter, or granules, and iron; or other substances that are prone to sparking when contacted by the head of a golf club swung at approximately 100 mph. Typically, a binding agent is used, such as a starch or sugar, wherein the metallic pieces are mixed and coated on the golf tee. Colors, including gold, red, green and blue, for example, can be utilized in combination with the substance which, in turn, may be a combustible material, preferably a gunpowder type material consisting of sodium and/or potassium nitrates (or chlorates) with sulfur and carbon, and powdered metals such as iron, aluminum, or magnesium. Because the material is encapsulated within the golf tee, the material is not exposed to air or the elements and therefor there is no risk of oxidation or moisture absorption and/or adulteration during storage or packaging. What is more, encapsulation of the material prevents the material from being ruptured or otherwise damaged during storage or packaging. By adding nitrate or chloride salts of strontium (red), barium (green) and copper (blue), colors are produced with the spark. Additionally, encapsulation of the spark induction material/contact alert material causes pressure and compression so that the spark is brighter and/or larger.

The material may include flint-like material that emits sparks on contact with force, such as that exhibited via the golf club head. The flint-like material may be a mischmetal material or combinations thereof. Mischmetal, rare earth mischmetal or misch metal is an alloy of rare earth elements. Its most common use is in the ferrocerium "flint" ignition device of many lighters and torches, although an alloy of only rare-earth elements would be too soft to give good sparks. Preferably the subject coating is made up of a mischmetal composition including approximately 50% cerium and 25% lithium and small amounts of neodymium and praseodymium blended with iron oxide and magnesium oxide to form a harder material known as ferrocerium.

Preferably, the alert material is non-flammable in nature to mitigate fire risks. In one embodiment, the golf tee is encapsulated with a thin portion of a mixture containing potassium chlorate, sulfur, glue and powdered glass (silica) to produce a spark when hit by a high silica-containing substance.

The velocity of the golf club head and the substance with which the tee is encapsulated interacts to create a sparking effect at various club head speeds ranging from about 70 to 120 mph. Different substances can be used to create different spark colors, and the substance can be designed to work even when the grass within which the tee is inserted becomes damp or wet with dew. Upon contact with a golf club, the side walls bend to strike the contact alert material, or fracture or break and the golf club will strike the contact alert material causing a spark; a golfer witnessing the sparking action is thereby informed that the golf swing has been properly executed.

The subject spark inducing golf tee, and method of use thereof, provides a novel training aid that is economical, compact, and encourages proper golfing form.

FIG. 1 illustrates a side plan view of an embodiment of the subject golf tee, shown generally at 1000. The subject golf tee has a spark generating material encapsulated therein, which sparks upon impact of a golf swing so that the golfer immediately realizes when a proper golf swing has been executed. Golf tee 1010 includes a top portion 1011 with a bottom wall 1011*c*, top wall 1011*a* and side walls 1011*b*. Top portion 1011 is fixedly attached to a shaft 1012 which terminates into a point 1013. Top portion 1011 may have many different shape configurations but generally includes a curved or concave surface appointed to receive a golf ball prior to a golfer teeing off. Point 1013 and a substantial portion of shaft 1012 are adapted to be inserted into the ground when the golfer is getting ready to tee off. A golf ball is adapted to be placed on the top wall 1011*a* within the concavity of top portion 1011.

An enclosed cavity 1019 is located within top portion 1011 located centrally within the golf tee and enclosed within side walls 1011*c*, top wall 1011*a* and bottom wall 1011*b*. A contact alert material 1020 is located within cavity 1019 so that the material 1020 is encapsulated therein. Preferably the contact alert material 1020 extends downward from the top wall 1011*a* of the tee at IV to a depth II on a vertical plan xi-xi. Preferably, as shown, the contact alert material 1020 and visa vie cavity 1019 extends from the top wall 1011*a* to the bottom wall 1011*b* and may even extend into at least a portion of shaft 1012. The cavity 1019 entirely encapsulates contact alert material 1020 so that contact alert material 1020 is pressurized within the cavity to produce a greater spark upon the golf club strike.

When the side walls 1011*b* are struck by a golf club, the side walls forcibly impact the contact alert material 1020 and the contact alert material 1020 explodes, fracturing the side walls and releasing a spark. Alternatively, when the side walls 1011*b* are struck by a golf club, the side walls fracture or break and the club simultaneously strikes the contact alert material 1020 so that the contact alert material 1020 explodes. The spark strength provides immediate indication to the golfer as to the quality of the golf swing. If the golf tee and ball are hit with perfect form and swing force or velocity, the spark will be bright and large; if the golf swing is mediocre there may be a slight spark. However, if the golf swing is poor, no spark or a minimum small spark will be generated. Preferably, the alert is a spark that is generated upon forceful contact of the golf club head striking the ball and contacts golf tee 1010 at the material/golf tee interface.

The golf club head and/or ball is unadulterated or un-manipulated so that it follows USGA rules and regulations. Contact alert material 1020 may optionally further include a snap sound generation upon the golf tee being struck by the unadulterated golf club head.

Side walls 1011*b* are constructed having a shallow dept MM so that the side walls 1011*b* fracture, crack or break upon impact and fall away so that the golf club head swing carries through to make contact with or strike the alert material located in cavity 1019 causing impact and, consequently, the alerting spark and/or audible sound. Preferably, side walls 1011*b* have a depth MM ranging from about 0.001-3.0 mm and are composed of wood or a polymeric material. Alternatively, the side walls 1011*b* are composed of a thin flexible polymeric material (ranging from about 0.001-3.0 mm) that compress inward striking the alert material in cavity 1019 causing pressurization of the cavity 1019 and instantly causing the contact alert material 1020 to explode or spontaneously combust and forcibly break through the side walls 1011*b* and yield a visible spark visible to the golfer and surrounding bystanders.

Figure 2A:
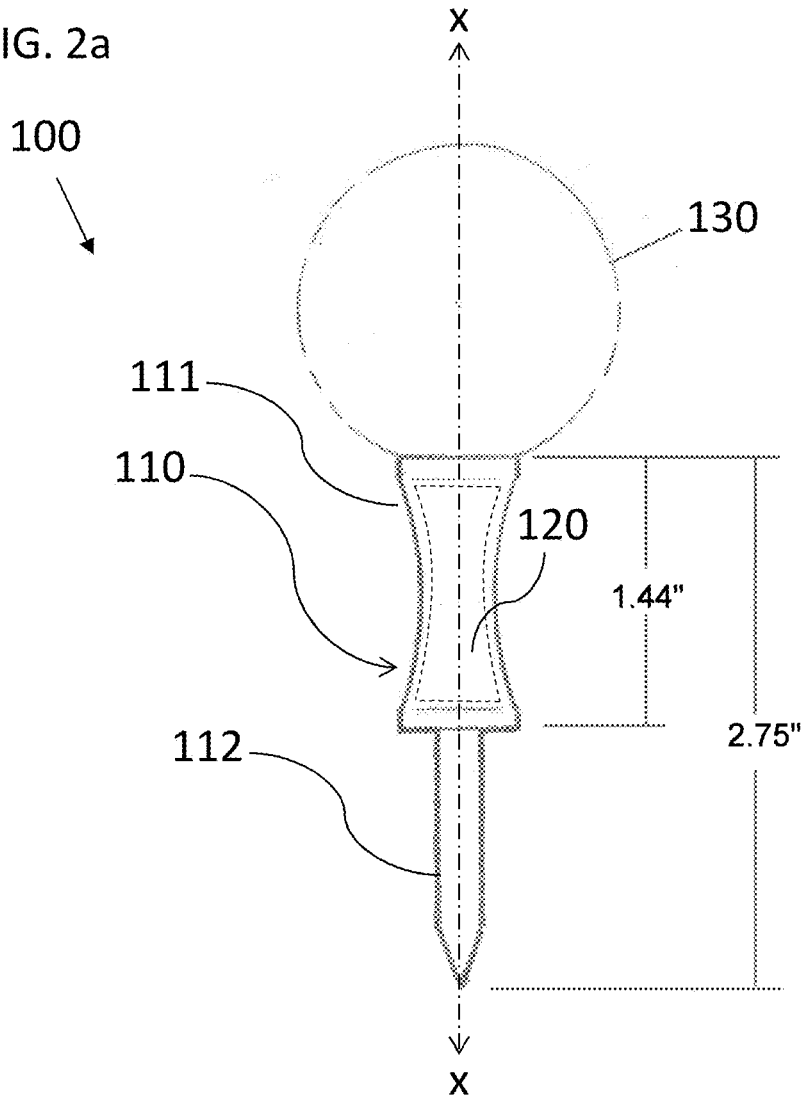
FIG. 2*a* illustrates a side plan view of another embodiment of the subject golf tee with a golf ball mounted thereon.
Figure 2B:
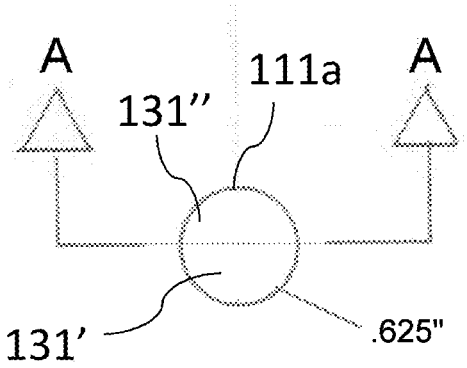
FIG. 2*b* illustrates a top plan view of FIG. 2*a;*
Figure 2C:
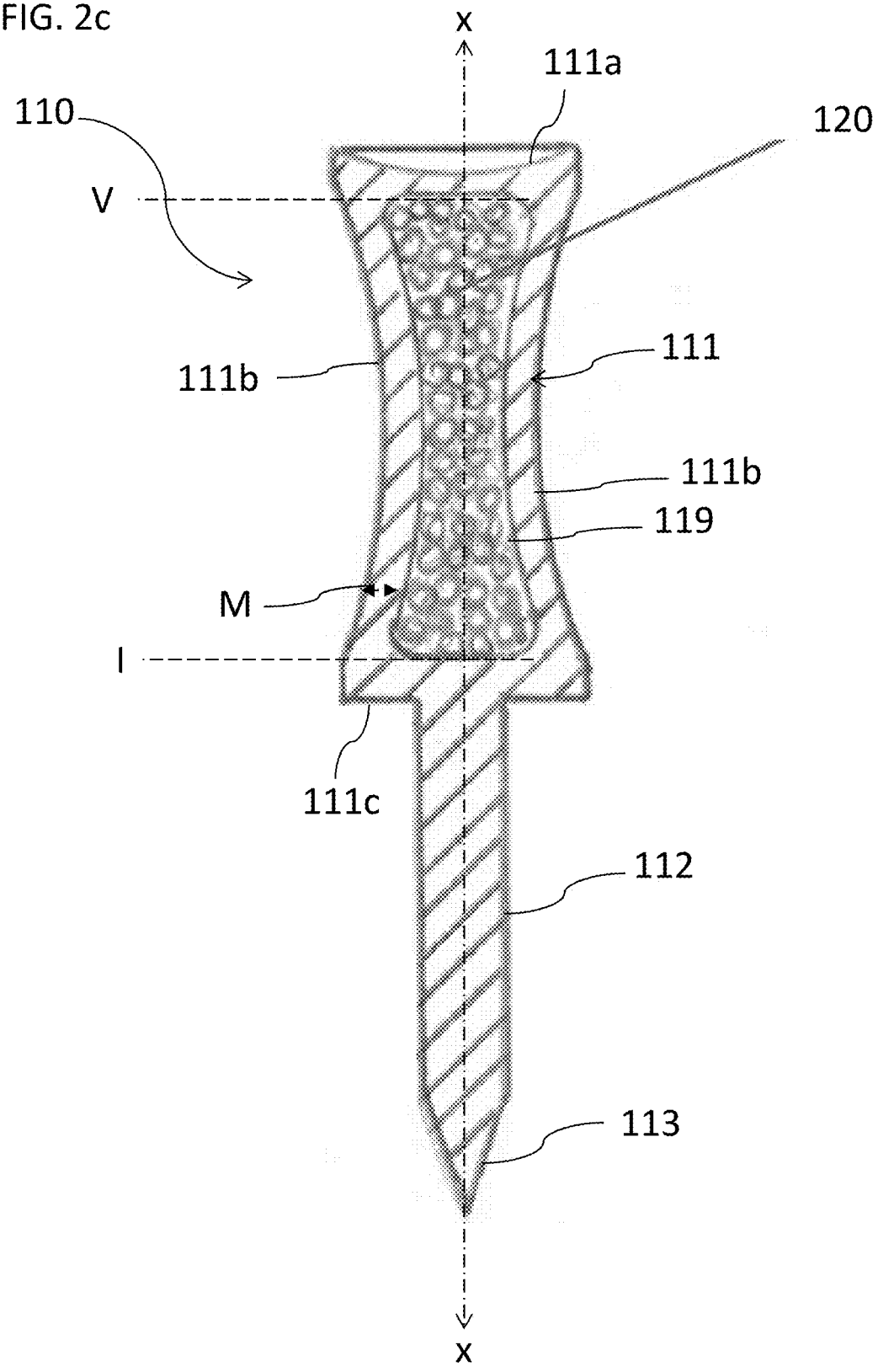
FIG. 2*c* illustrates a cross-sectional view taken along A-A of the golf tee of FIG. 2*a;*
Figure 2D:
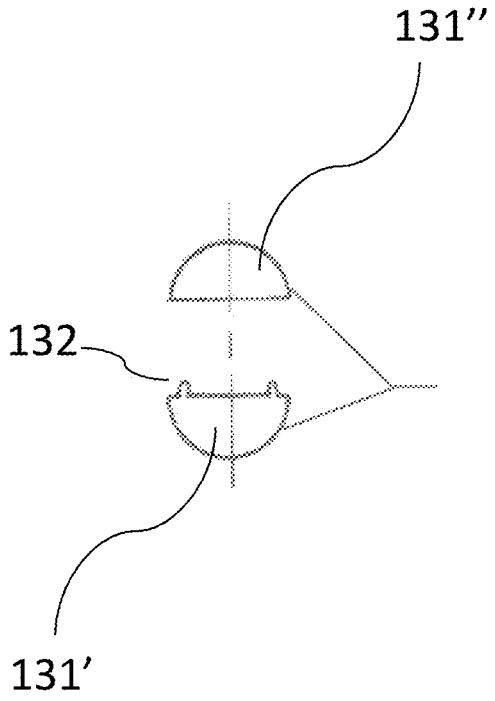
FIG. 2*d* illustrates molding of the golf tee of FIG. 2*a;*

FIG. 2*a* illustrates a side plan view of an embodiment of the subject golf tee with a golf ball mounted thereon, shown generally at 100. FIG. 2*b* illustrates a top plan view of FIG. 2*a*. FIG. 2*c* illustrates a cross-sectional view taken along A-A of the golf tee of FIG. 2*a*. FIG. 2*d* illustrates molding of the golf tee of FIG. 2*a*. The subject golf tee has a spark generating material is encapsulated therein that sparks only, or in an alternative embodiment sparks and makes an audible sound upon being struck by a golf club. Golf tee 110 includes a top portion 111 with a bottom wall 111*c*, top wall 111*a* and side walls 111*b*. Top portion 111 is fixedly attached to a shaft 112 which terminates into a point 113. Top portion 111 may have many different shape configurations but generally includes a curved or concave surface appointed to receive a golf ball prior to a golfer teeing off. Point 113 and a substantial portion of shaft 112 are adapted to be inserted into the ground when the golfer is getting ready to tee off. A golf ball, as shown at 130, is adapted to be placed on the top wall 111*a* within the concavity of top portion 111.

Top portion 111 includes an enclosed cavity 119 located within side walls 111*b*, top wall 111*a* and bottom wall 111*c*. A contact alert material 120 is located within cavity 119 so that the material 120 is encapsulated within cavity 119. Preferably the contact alert material 120 extends downward from the top of the tee at a depth V from top wall 111*a* to depth I on the vertical plan x-x. Preferably, as shown, the contact alert material 120 and vis-a-vis cavity 119 extends from the top wall 111*a* to the bottom wall 111*b*. The cavity 119 entirely encapsulates contact alert material 120 so that contact alert material 120 is not exposed to the environment until or unless the tee is struck with a force y causing side walls 111*b* to fracture or break and the contact alert material 120 then being contacted by or struck by the golf club, thereby generating an alert that the tee has been hit with the proper force or velocity and proper swing trajectory. Preferably, the alert is a spark that is generated upon forceful contact of the golf club head striking the ball 130 and contacts golf tee 110 at the material/golf tee interface. Alternatively, the alert includes sparks and makes an audible sound upon being struck by the golf club.

The golf club head is unadulterated or un-manipulated so that it follows USGA rules and regulations. Contact alert material 120 may optionally further include a snap sound generation upon the golf tee being struck by the unadulterated golf club head.

Side walls 111*b* are constructed having a shallow dept M so that the side walls 111*b* fracture, crack or break upon impact and fall away so that the golf club head swing carries through to make contact with or strike the alert material located in cavity 119 causing impact and visa vie the alerting spark and/or auditory. Preferably, side walls 111*b* have a depth M ranging from about 0.001-3.0 mm and are composed of wood or a polymeric material.

As best viewed in FIG. 2*d*, in a preferred method of manufacturing the golf tee mating first half 131' and second half 131" are attached or mated forming the golf tee. The two halves are formed with an insert or groove or cavity and the contact alert coating placed therein. Preferably, the first half 131' includes appendages 132 that are received within aligned mating apertures of second half 131" so that the two halves 131', 131" are snapped together to form the golf tee.

It is noted that the side walls may be constructed of the same material as the rest of the body of the golf tee or may be composed of a different material than the rest of the body of the golf tee. Preferably, the side walls have a shallow depth/thickness ranging from about 0.001-3.0 mm keeping the golf tee compact, but also providing for easy breakage and penetration of the encapsulated contact alert material. In one embodiment, the side walls are composed of a material that breaks or shatters upon impact by the head of the golf club. The material may be made up of a cellulose material, such as a papier-mâché or a composite material consisting of paper pieces or pulp, sometimes reinforced with textiles, bound with an adhesive, such as glue, starch, or wallpaper paste, or a wood or veneer material. Alternatively, the side walls may be composed of a polymeric material. In yet another embodiment, the side walls are composed of a thin film layer of a wax, paraffin or polymeric material that is adapted to immediately rupture to provide contact to the contact alert material upon impact with the golf club head. Preferably, the side walls are composed of nitrocellulose, potassium nitrate and/or priming powder.

The contact alert material may also generates a sound upon impact along with the spark. The contact alert material is preferably entirely encapsulated within the cavity so that no part of the contact alert material is exposed to or visible from the exterior of the golf tee unless or until the side walls or top wall or bottom wall of the golf tee is broken or fractured.

Typically, the contact alert material has a thickness ranging from about 0.003 inches to 1.5 inches. Preferably, the contact alert material has a thickness ranging from about 0.1 inches to 0.5 inches. The contact alert material may further include a coloring to generate different color sparks and/or the material may include ground-up asphalt and/or small metallic pieces. In one embodiment, the contact alert material is adapted to generate a spark when contacted by the head of the golf club swung at speeds ranging from about 70 to 120 mph. The golf tee may be part of a golf training system including a golf ball, a golf club and the golf tee, or may be a stand-alone golf tee capable of being utilized with virtually any golf ball and/or golf club.

Figure 3:
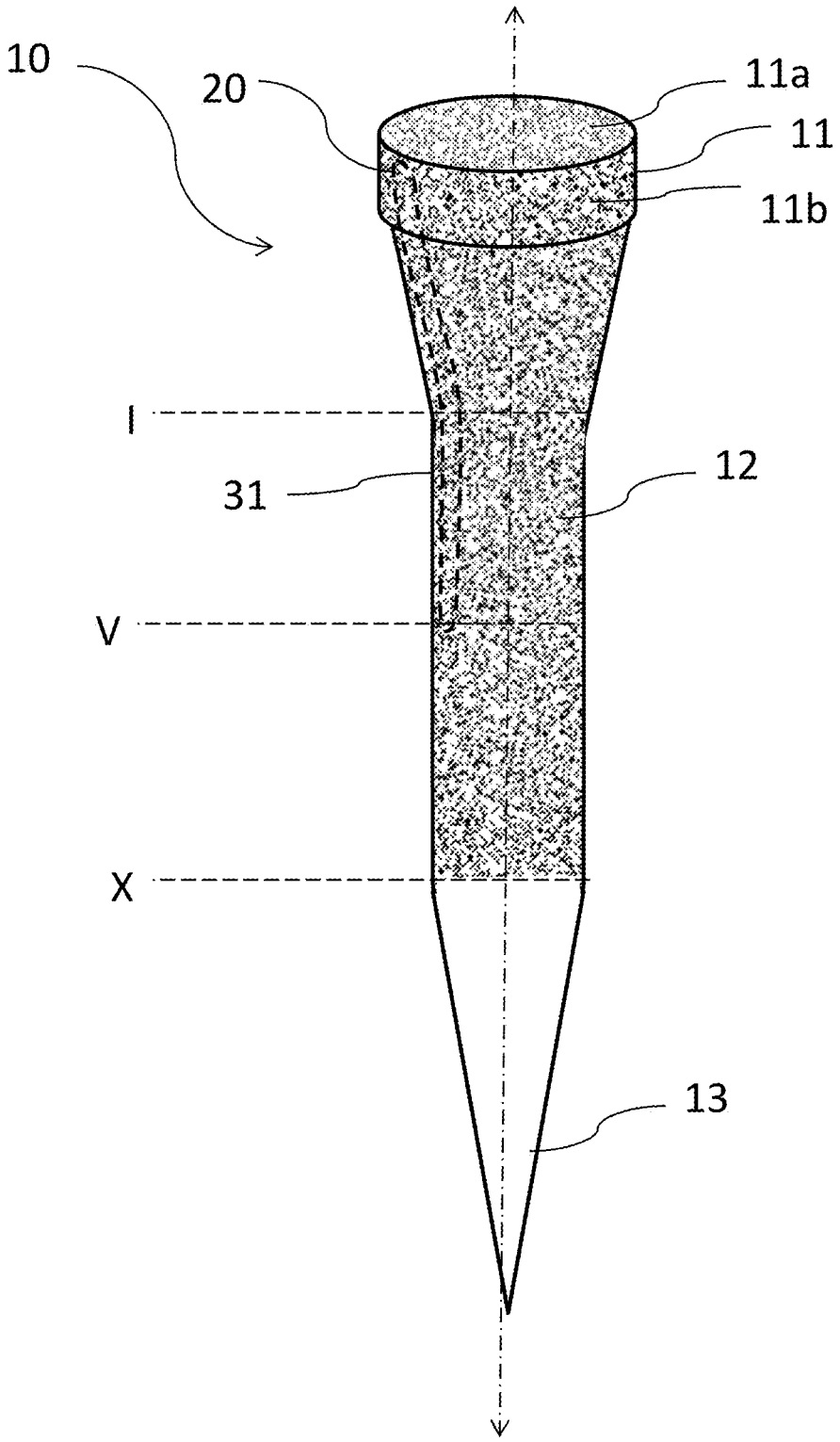
FIG. 3 illustrates a plan view of an embodiment of the subject golf tee.
Figure 4:
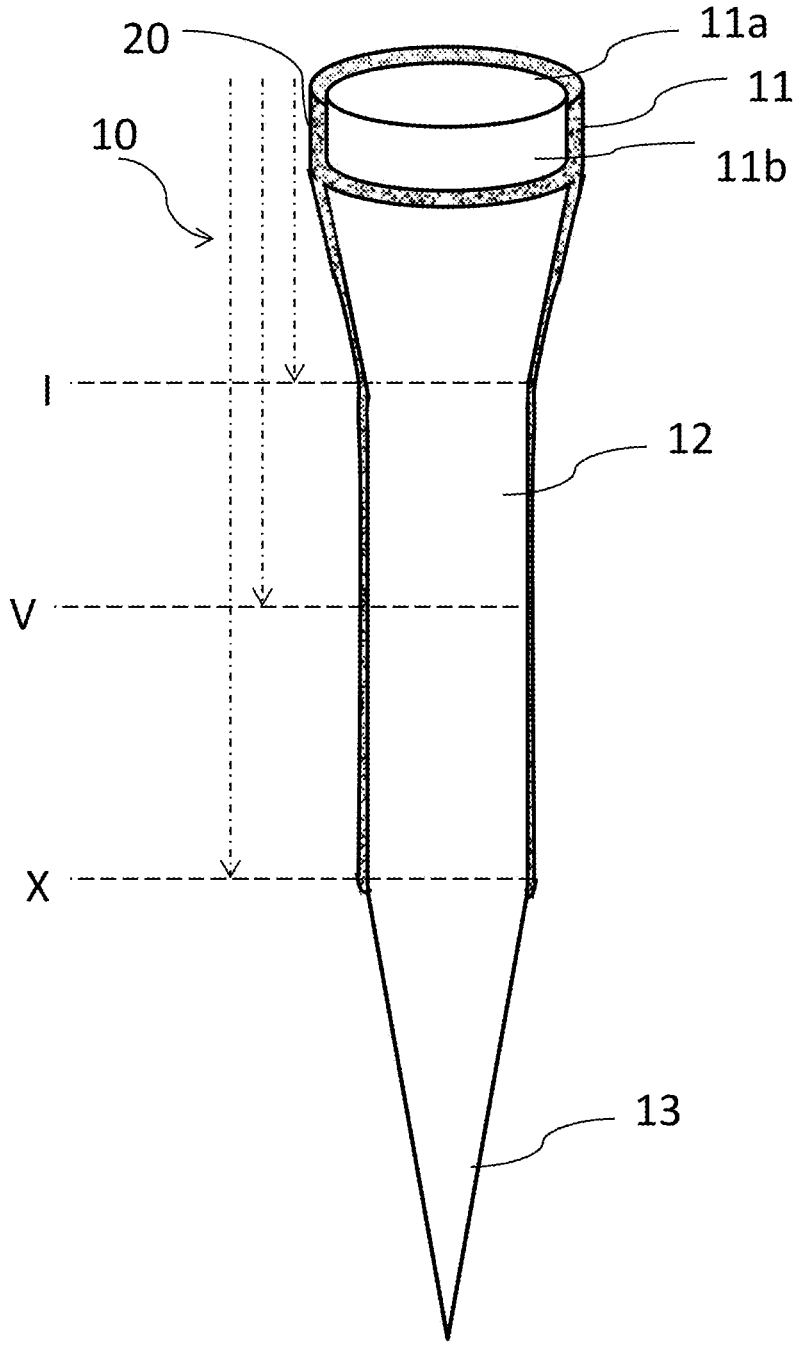
FIG. 4 illustrates a cross-sectional view taken along line x-x in FIG. 3.
Figure 5:
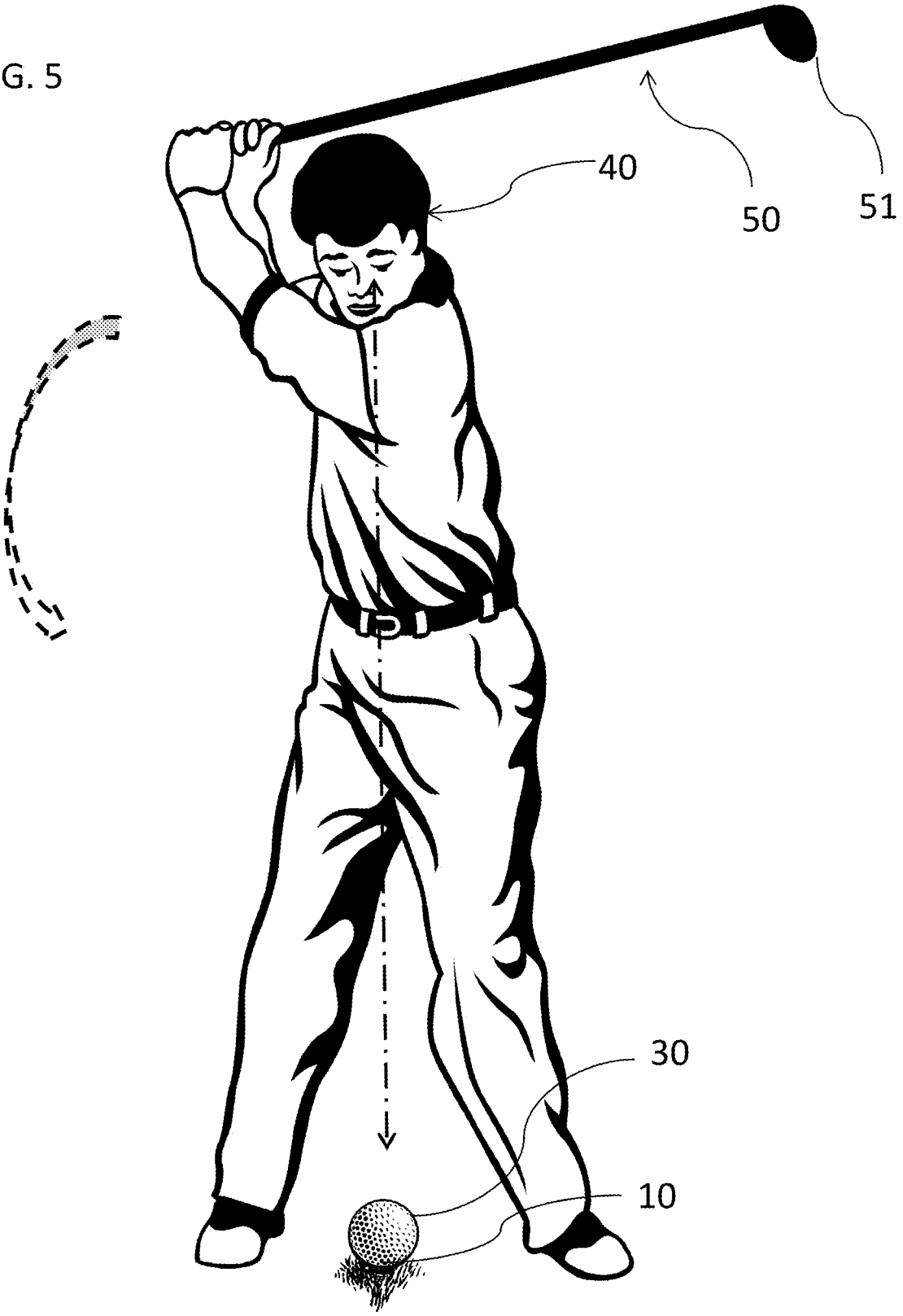
FIG. 5 illustrates a view of an embodiment of the golf tee in use with a golfer getting ready to tee off in proper form.
Figure 6:
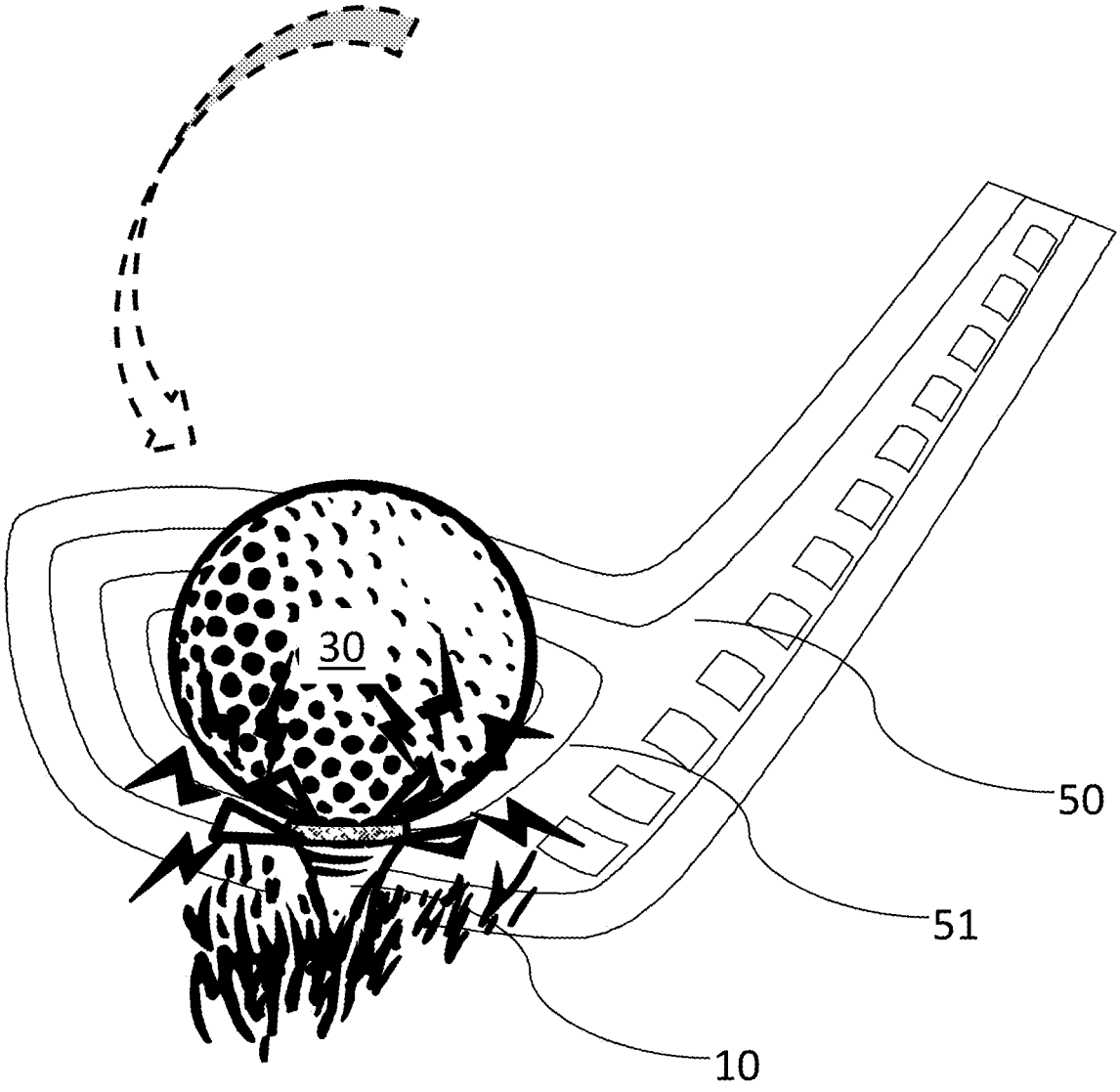
FIG. 6 illustrates a view of an embodiment of the golf tee in use, showing impact of a club head with the golf tee, and a spark generated from the coating on the golf tee.

FIGS. 3-6 illustrate views of an embodiment of the subject golf tee which may be configured alone or in addition to the encapsulated embodiment discussed hereinabove. FIG. 3 illustrates a plan view of an embodiment of the golf tee; FIG. 4 illustrates a cross-sectional view taken along line x-x in FIG. 3; FIG. 5 illustrates a view of an embodiment of the golf tee in use with a golfer getting ready to tee off with proper form; and FIG. 6 illustrates a view of an embodiment of the golf tee in use with impact of a golf club and spark generation therefrom.

In referring to FIGS. 3-6, generally, the golf tee 10 has a size and shape of a typical golf tee. Golf tee 10 includes a top plate 11 with a top wall 11*a* and side walls 11*b*. Top plate 11 is fixedly attached to a shaft 12 which terminates into a point 13. Top plate 11 may have many different shape configurations. Point 13 and a substantial portion of shaft 12 are inserted into the ground when a golfer is getting ready to tee off. A golf ball, as shown at 30 in FIGS. 4 and 5, is adapted to be placed on top of top plate 11. A contact alert coating 20 is applied to at least an upper portion of the golf tee 10. Preferably the contact alert coating 20 extends downward from the top of the tee to line I; alternatively, contact alert coating 20 extends downward to line V; in another embodiment, the contact alert coating 20 extends substantially down on the golf tee body to line X. When the powder/contact alert coating 20 extends further down the tee shaft (as to line V and/or X), it increases the chances for contact and spark ignition. Contact alert coating 20 is preferably a coating that generates a spark upon forceful contact of a golf club head 51 on the golf tee when a golf club 50 is swung so that head 51 strikes ball 30 and contacts golf tee 10 at the coating/golf tee interface. The golf club head 51 is unadulterated or un-manipulated so that it complies with USGA rules and regulations. Contact alert coating 20 may optionally further include a snap sound generation upon the golf tee being struck by the unadulterated golf club head 51.

Contact alert coating 20 is preferably a non-flammable substance so that it does not pose a fire hazard. Further, the non-flammable coating 20 will not be subject to flammability when stored in the trunk of a vehicle and will not inadvertently be ignited. In one embodiment, the golf tee is coated with a thin layer of a mixture containing potassium chlorate, sulfur, glue and powdered glass (silica) to produce a spark when hit by a high silica-containing substance; this surface may be sprayed on the golf tee via aerosol. In another embodiment, the contact alert coating 20 is a substance such as ground-up asphalt, small metallic pieces (for example magnesium) or other substance that is prone to sparking when the coating of the golf tee is contacted by the head of a golf club swung at approximately 100 mph. The velocity of the golf club head and the substance with which the tee is coated interacts to create a sparking effect at various club head speeds ranging from about 70 to 120 mph. Different substances can be used to create different spark colors, and the substance can be designed to work even when the grass within which the tee is inserted becomes damp or wet with dew. Upon contact with a golf club, the tee will spark; a golfer witnessing the sparking action is thereby informed that the golf swing has been properly executed. In an alternative embodiment, a firecracker like coating may be applied in conjunction with or just under the spark coating layer so that if a fast speed (~100 mph) is used, there will also be a firecracker type sound effect, which signifies a very fast swing speed.

As illustrated in FIGS. 3 and 4, coating 20 may be located on at least a portion of the top wall surface 11*a* of top plate 11. Alternatively, coating 20 may be located on at least a portion of side walls 11*b* of top plate 11. Optionally, coating 20 may be located on both the side walls 11*b* and top wall 11*a* of the top plate 11. What is more, coating 20 may extend down a portion of shaft 12. The coating 20 preferably has a thickness of 0.001 to 1 inch. Preferably contact alert coating 20 extends downward from the top of the tee to line I; alternatively, contact alert coating 20 extends downward to line V; in another embodiment, the contact alert coating 20 extends substantially down on the golf tee body to line X. When the powder/contact alert coating 20 is further down the tee shaft (as to line V and/or X), it increases the chances for contact and spark ignition.

The subject golf tee 10 provides a training aid that is fun to use and entertaining, as well. Proper golfing form is promoted by encouraging the golfer to keep his head 40 looking in the downward facing position, as indicated in FIG. 5. The golfer 40 tees-up the ball in the usual way. As the golf club is swung at approximately about 70 to 120 mph and makes contact with the golf tee 10, the velocity of the golf club head and the coating interacts to create a sparking effect at various club head speeds. Upon contact with a golf club, the tee will spark; a golfer witnessing the sparking action is thereby informed that the golf swing has been properly executed.

Figure 7:
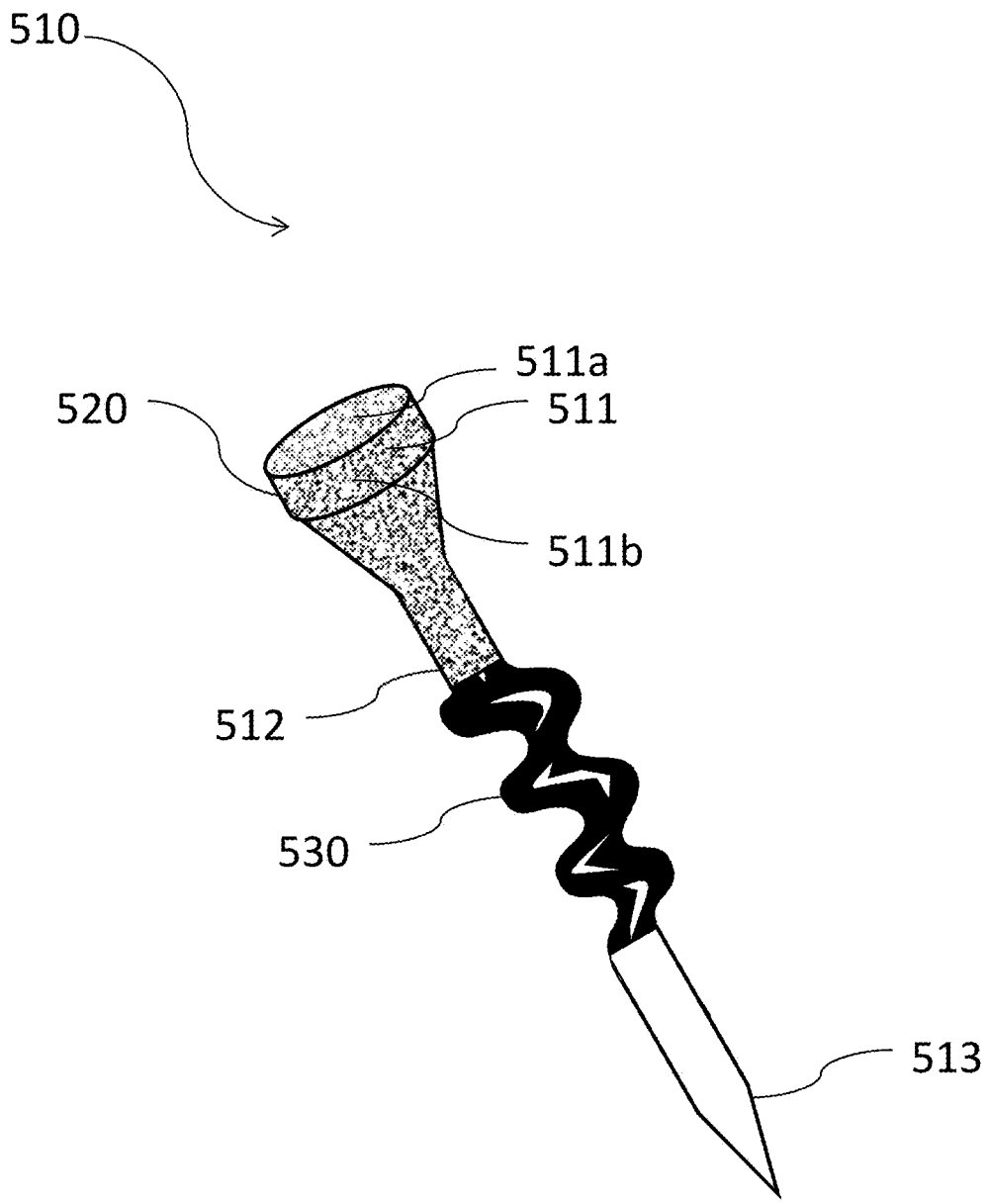
FIG. 7 illustrates a view of an embodiment of the golf tee wherein the golf tee has a spiral-shaped body.

FIG. 7 illustrates a view of an embodiment of the golf tee wherein the golf tee has a spiral-shaped body, shown generally at 500. In this embodiment the body of the tee is spiraled to assist in holding the tee in place and stabilizing the tee to ensure optimum contact force. Golf tee 510 includes a top plate 511 with a top wall 511*a* and side walls 511*b*. Top plate 511 is fixedly attached to a shaft 512 terminating at a spiral section 530, which in turn terminates into a point 513. Point 513 and a substantial portion of spiral section 530 and a portion of shaft 512 are inserted into the ground when a golfer is getting ready to tee off. A contact alert coating 520 is applied to at least an upper portion of the golf tee 510. Contact alert coating 520 is preferably a coating that generates a spark upon forceful contact of a golf club when it strikes the ball and contacts golf tee 510 at the coating/golf tee interface. Spiral section 530 has at least one spiral which acts to stabilize the tee in the ground for added contact force between the golf club and tee.

Figure 8A:
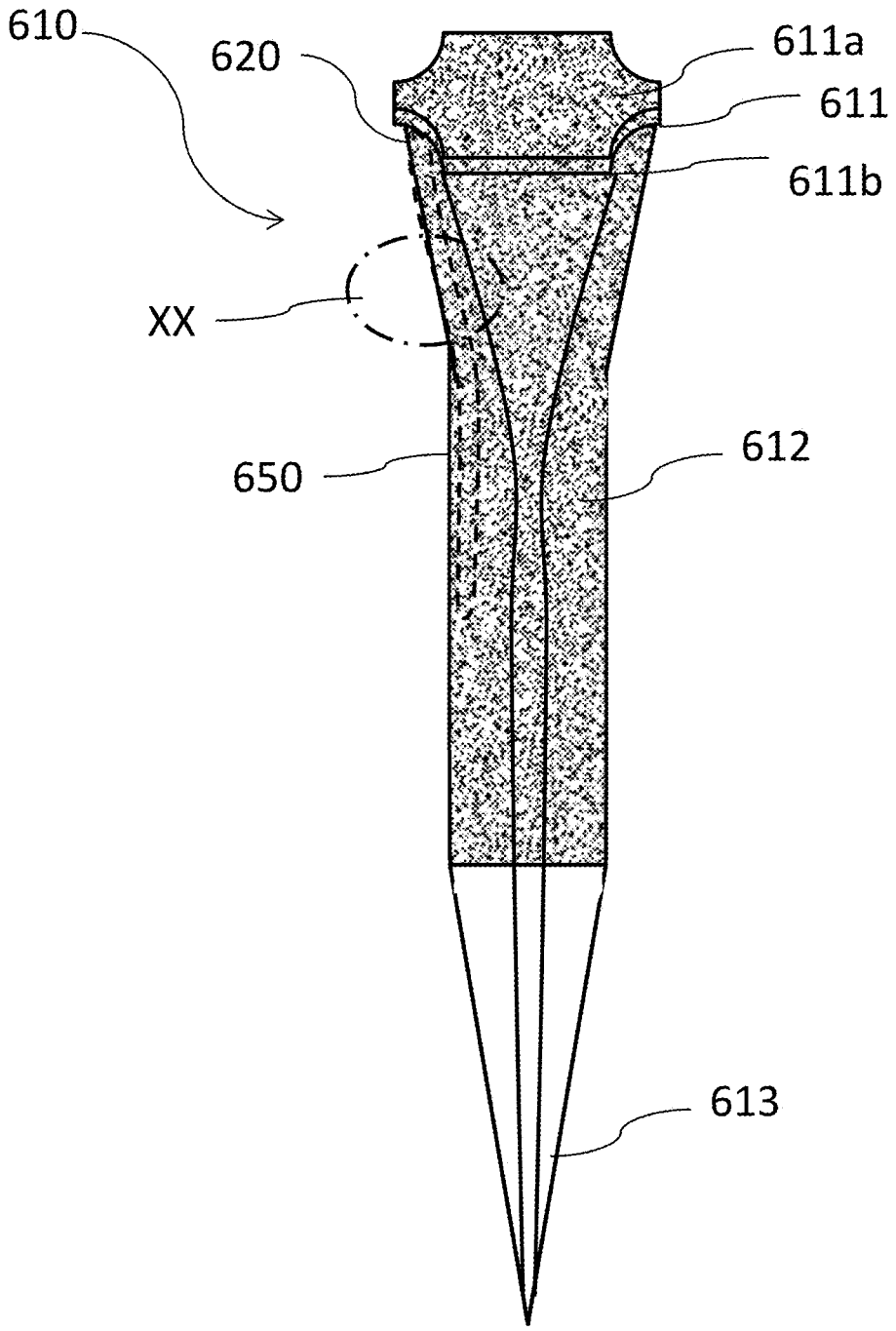
FIG. 8*a* illustrates a plan view of an embodiment of the subject golf tee wherein the golf tee is shaped having divots containing a higher concentration of spark inducing substance.
Figure 8B:
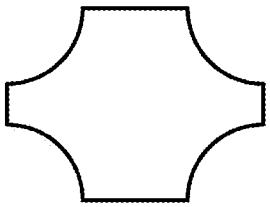
FIG. 8*b* illustrates a top view of the tee of FIG. 8*a*.
Figure 8C:
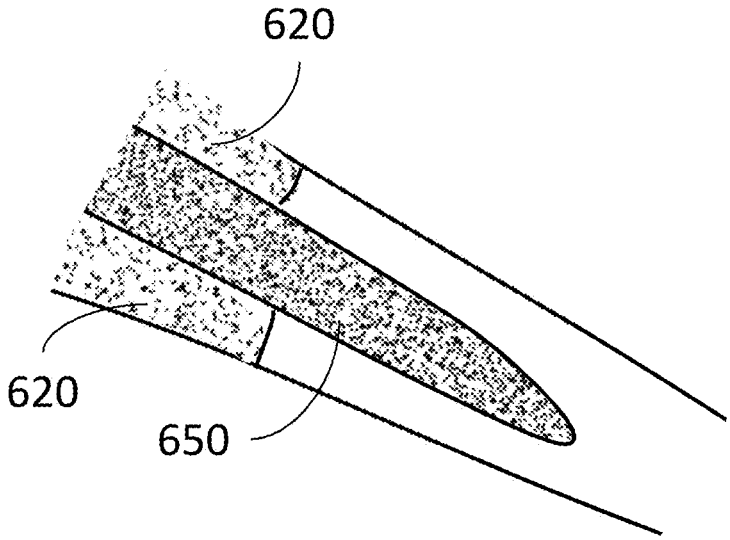
FIG. 8*c* illustrates a sectional view of FIG. 8*a* taken along XX.

FIGS. 8*a*-8*c* illustrate another embodiment of the golf tee. FIG. 8*a* illustrates a plan view of an embodiment of the subject golf tee wherein the golf tee comprises divots containing a higher concentration of spark inducing substance, shown generally at 610. FIG. 8*b* illustrates a top view of the tee of FIG. 8*a*. FIG. 8*c* illustrates a sectional view of FIG. 8*a* taken along XX. Referring to FIGS. 8*a*-8*c*, golf tee 610 includes a top plate 611 with a top wall 611*a* and side walls 611*b*. Top plate 611 is fixedly attached to a shaft 612 terminating at a point 613. A contact alert coating 620 is applied to at least an upper portion of the golf tee 610. Contact alert coating 620 is preferably a coating that generates a spark upon forceful contact of a golf club when it strikes the ball and contacts golf tee 610 at the coating/golf tee interface. A divot 650 holding more powder for enhancing the spark or contact alert is provided (see cross-section XX (see FIG. 8*c*)). The divot 650 may further project slightly from the tee body as a dart to stabilize the tee in the ground, while increasing chances for spark ignition.

Advantages are realized through manufacture of the spark inducing golf tee and method of using same to promote proper golfing form. These and other advantages include, for example:

1) empowers golfers to improve his/her golf swing in a very inexpensive manner;
2) provides entertainment and added excitement on the golf course;
3) conveys immediate feedback to a golfer which provides confirmation that a proper swing hit has taken place;
4) provides a low cost, reliable and effective means for improving golf posture and swing carry through;
5) improves confidence of the golfer during a golf round; and
6) provides a minimally invasive, readily discernible, quick method of improving golf swing.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A golf tee having a contact alert material encapsulated therein comprising:

a. a top portion with a top wall, side walls and a bottom wall, said bottom wall of said top portion being fixedly attached to a shaft that terminates into a point, said point and a portion of said shaft being appointed to be inserted into a ground surface when a golfer is getting ready to tee off and a golf ball is placed on said top wall of said top portion;

b. a cavity formed between said top, side and bottom walls of said top portion;

a. a contact alert material being encapsulated within said cavity and being composed of a combustible material that is placed under pressure and compression by said side walls and generates a spark on impact;

d) said side walls having a shallow depth and being composed of a side wall material that is a different material than rest of said gold tee and that breaks or shatters upon impact by a head of a golf club so that said golf club instantaneously strikes said contact alert material encapsulated in the golf tee;

whereby said contact alert material is appointed to generate said spark during a golf swing when said golf club strikes said ball and said side walls, said alert being provided immediately as instantaneous feedback during said golf swing adapted to thereby improve muscle memory required to reliably replicate a proper golf swing.

2. A golf tee as recited by claim 1, wherein said side walls have a shallow depth ranging from about 0.001-3.0 mm.

3. A golf tee as recited by claim 1, wherein said side wall material is a cellulose material.

4. A golf tee as recited by claim 1, wherein said side wall material is a polymeric material.

5. A golf tee as recited by claim 1, wherein said side walls are composed of a thin film layer of a wax, paraffin or polymeric material that is adapted to immediately rupture to provide contact to said contact alert material upon impact with said golf club head.

6. A golf tee as recited by claim 1, wherein said contact alert material also generates a sound upon impact.

7. A golf tee as recited by claim 1, wherein said contact alert material is entirely encapsulated within said cavity.

8. A golf tee as recited by claim 1, wherein said contact alert material has a thickness ranging from about 0.003 inches to 1.5 inches.

9. A golf tee as recited by claim 1, wherein said contact alert material has a thickness ranging from about 0.1 inches to 0.5 inches.

10. A golf tee as recited by claim 1, wherein said contact alert material further comprises a coloring to generate different color sparks.

11. A golf tee as recited by claim 1, wherein said contact alert material comprises zirconium.

12. A golf tee as recited by claim 1, wherein said alert material comprises mercury fulminate.

13. A golf tee as recited by claim 1, wherein said contact alert material comprises silver fulminate.

14. A golf tee as recited by claim 1, wherein said contact alert material comprises zirconium is entirely encapsulated within said golf tee and not on an exterior or outside of said golf tee.

15. A golf tee as recited by claim 1, wherein said contact alert material is adapted to generate a spark when contacted by said head of said golf club swung at speeds ranging from about 70 to 120 mph.

16. A golf tee as recited by claim 1 comprising a golf training system including a golf ball, a golf club and said golf tee.

17. A method of use of a golf tee with a golf training aid having a golf club and a golf ball for encouraging proper golfing form, said golf tee comprising:

a) a top portion with a top wall, side walls and a bottom wall, said bottom wall of said top portion being fixedly attached to a shaft that terminates into a point, said point and a portion of said shaft being appointed to be inserted into a ground surface when a golfer is getting ready to tee off and a golf ball is placed on said top wall of said top portion;

b) a cavity formed between said top, side and bottom walls of said top portion;

c) contact alert material being encapsulated within said cavity and being composed of a combustible material that is placed under pressure and compression by said side walls and generates a spark on impact;

d) side walls having a shallow depth and being composed of a side wall material that is a different material than rest of said golf tee and that breaks or shatters upon impact by a head of a golf club so that said golf club instantaneously strikes said contact alert material encapsulated in the golf tee;

whereby said contact alert material is appointed to generate said spark during a golf swing when said golf club strikes said ball and said side walls, said alert being provided immediately as instantaneous feedback during said golf swing adapted to thereby improve muscle memory required to reliably replicate a proper golf swing.

18. A method of manufacturing a golf tee having a contact alert material encapsulated therein comprising:

a) forming mating first half and second half of said golf tee, each first half and second half having a half of a top wall, side walls with a cavity and a bottom wall, said bottom wall of said top portion being fixedly attached to a half shaft that terminates into a half point, said side walls having a shallow depth and being composed of a side wall material that is a different material than rest of said golf tee and that breaks or shatters upon impact by a head of a golf club so that said golf club instantaneously strikes said contact alert material encapsulated in the golf tee;

b) inserting a contact alert material composed of a combustible material that generates a spark on impact within each of said cavity of said first half and second half;

c) attaching said first half to said second half to form golf tee so that said contact alert material is encapsulated within said golf tee and is placed under pressure and compression by said side walls and generates said spark;

whereby said contact alert material is appointed to generate said spark during a golf swing when said golf club strikes said ball and said side walls, said alert being provided immediately as instantaneous feedback during said golf swing adapted to thereby improve muscle memory required to reliably replicate a proper golf swing.

19. A golf tee as recited by claim 1, wherein said side wall material is composed of one or more of nitrocellulose, potassium nitrate and priming powder.

* * * * *